US012139919B2

(12) United States Patent
Guset

(10) Patent No.: US 12,139,919 B2
(45) Date of Patent: Nov. 12, 2024

(54) TILE NICHE HOLDER TOOL, METHOD, AND SYSTEM

(71) Applicant: Ioan Guset, Chicago, IL (US)

(72) Inventor: Ioan Guset, Chicago, IL (US)

( * ) Notice: Subject to any disclaimer, the term of this patent is extended or adjusted under 35 U.S.C. 154(b) by 209 days.

(21) Appl. No.: 17/799,095

(22) PCT Filed: Mar. 12, 2021

(86) PCT No.: PCT/US2021/022105
§ 371 (c)(1),
(2) Date: Aug. 11, 2022

(87) PCT Pub. No.: WO2021/188376
PCT Pub. Date: Sep. 23, 2021

(65) Prior Publication Data

US 2023/0082426 A1 Mar. 16, 2023

Related U.S. Application Data

(60) Provisional application No. 62/991,363, filed on Mar. 18, 2020.

(51) Int. Cl.
*E04F 21/00* (2006.01)
*E04F 21/18* (2006.01)

(52) U.S. Cl.
CPC ..... *E04F 21/185* (2013.01)

(58) Field of Classification Search
CPC ..... E04F 21/00; E04F 21/165; E04F 21/1844; E04F 21/185; E04F 21/1877; E04F 21/20
See application file for complete search history.

(56) References Cited

U.S. PATENT DOCUMENTS

| | | | |
|---|---|---|---|
| 1,519,637 | A | 12/1924 | Shannon, Jr. |
| 1,836,846 | A | 12/1931 | Hannay |
| 3,744,141 | A | 7/1973 | Strickland, Sr. |
| 4,583,343 | A | 4/1986 | Camp |
| 4,860,518 | A | 8/1989 | Kingham |
| 5,263,260 | A | 11/1993 | Smith |

(Continued)

FOREIGN PATENT DOCUMENTS

| | | | |
|---|---|---|---|
| CA | 2143724 | A1 | 9/1996 |
| CA | 2826804 | A1 | 8/2014 |

OTHER PUBLICATIONS

Supplementary European Search Report for EP 21 77 1880; Dated Mar. 28, 2024; 9 paged.

*Primary Examiner* — Chi Q Nguyen
(74) *Attorney, Agent, or Firm* — Taft Stettinius & Hollister LLP; Jane S. Berman

(57) ABSTRACT

A support tool for installing tiles onto a wall above a niche in the wall provides support for tiles being mounted above the niche. The tool includes a support plate configured to be secured to or braced against an upper surface of the niche. A tile support bar supporting lower edges of the tiles may be adjusted and held in a selected vertical position relative to the plate, so that lower edges of tiles may be placed in a desired vertical position relative to the upper surface of the niche. The tile support bar may be slidably supported on a support rod in a selected position by a nut threaded onto the support rod. The tool may be secured in position by screwing the support plate onto the upper surface of the niche, or by bracing the tool in place using a length-adjustable extender assembly.

13 Claims, 12 Drawing Sheets

(56) References Cited

U.S. PATENT DOCUMENTS

| | | | | |
|---|---|---|---|---|
| 5,398,423 | A | 3/1995 | Smith | |
| 5,701,680 | A | 12/1997 | Garcia et al. | |
| 6,367,227 | B1 | 4/2002 | Veyna | |
| 7,070,667 | B1 | 7/2006 | Kirby | |
| 7,254,920 | B2 | 8/2007 | Steele | |
| 8,671,583 | B2 * | 3/2014 | Leonard | E04F 21/185 33/379 |
| 8,991,024 | B2 * | 3/2015 | Barillaro | B25B 5/166 29/559 |
| 9,303,666 | B2 * | 4/2016 | Rodi | B29C 51/264 |
| 9,464,448 | B2 | 10/2016 | Hoffman et al. | |
| 9,562,365 | B2 * | 2/2017 | Bucsa | E04F 21/20 |
| 10,029,351 | B2 * | 7/2018 | Hopf | B25B 5/163 |
| 11,041,314 | B2 * | 6/2021 | Kovacs | E04D 13/10 |
| 11,408,186 | B1 * | 8/2022 | Bunch | E04F 21/1877 |
| 11,649,647 | B2 * | 5/2023 | Bunch | E04F 21/1894 33/527 |
| 11,661,752 | B2 * | 5/2023 | Li | B25B 7/02 52/126.1 |
| 2004/0206027 | A1 * | 10/2004 | Steele | E04F 21/185 52/272 |
| 2006/0185319 | A1 * | 8/2006 | Kufner | E04F 21/0092 52/749.11 |
| 2011/0056628 | A1 * | 3/2011 | Ruf | B29C 51/26 156/538 |
| 2014/0325936 | A1 * | 11/2014 | PSaila | E04F 21/0092 52/749.11 |
| 2016/0376795 | A1 | 12/2016 | Irvine et al. | |

* cited by examiner

TILE NICHE HOLDER TOOL, METHOD, AND SYSTEM

CROSS REFERENCE TO RELATED APPLICATION

The present application is a national phase entry of International Application No. PCT/US21/22105 filed on Mar. 12, 2021 and claims the benefit of U.S. Provisional Patent Application No. 62/991,363 filed on Mar. 18, 2020, the contents of which are hereby incorporated by reference in their entirety.

TECHNICAL FIELD

The technical field relates to tools for use in mounting tiles, such as ceramic, stone, or metal tiles, onto a suspended vertical wall surface that has no horizontal bottom support below it, such as a wall surface located above a niche formed in a wall, or above another recessed surface such as a window frame.

BACKGROUND

There is a continuing need for improvement in implements and methods for quick and efficient installation of tiles in a manner that results in a smooth, even, high-quality tiled surface. Workers installing tiles, and in particular, large or heavy tiles like ceramic or stone tiles, onto a vertical surface located above a niche formed in the wall surface struggle to keep the tiles from slipping out of place due to the force of gravity, because the tiles have no support along their bottom edges. When installing tiles, the adherent material used to secure the rear surface of the tiles to the vertical surface of the wall requires some time to harden and to fix the tiles onto the surface. Before the adherent material hardens, often the adherent material meant to hold the tiles in place will have insufficient holding power. The result is that tiles have a lack of support and will slip downwardly out of place before the adherent material hardens. Thus, a low-quality installation may result, wherein the tiles are not secured in their correct positions. Prior solutions to this problem lack capabilities for quick installation of a support, and for quick removal and placement of the support for re-use. Prior solutions also lack adjustability to a number of different niche configurations and tile positioning requirements.

SUMMARY

In embodiments disclosed herein, the invention comprises novel designs for a support tool for use in installing tiles onto a surface. The tool provides a support for the bottom edge of tiles being mounted onto a vertical surface above a niche or other wall recess. The tool has features for quick installation and de-installation, for adjustment of the secured position of the bottom edge of the tiles relative to the position of the upper surface of the niche, for re-use in niches in many sizes and shapes, and for use in conditions where it is undesirable to drill holes in the wall or in the upper surface of the niche.

One embodiment is a tile installation tool that has a support plate configured to be affixed to an upper surface of a niche of a wall, and an adjustable tile support bar engaged with the support plate. The tile support bar is held in a selected position relative to a position of the support plate.

One example of this embodiment has a support rod connected to the support plate, wherein the tile support bar is slidably engaged with the support rod and the support rod supports the tile support bar in the selected position relative to the position of the support plate. This example also has a securing nut, wherein the securing nut is configured to secure the tile support bar in the selected position to provide support to a lower edge of at least one tile. In part of this example, the securing nut engages with exterior threads formed on the support rod to secure the tile support bar in the selected position. In another part, the support plate has a wall-side surface configured to be positioned to be flush with a surface of a wall into which a recess is formed, and the support plate has side wings that extend in a direction opposite to that of a horizontal upper surface of the support plate such that wall-side surfaces of the wings are flush with the surface of the wall.

Yet another part of this example has an extender assembly removably mounted to the tool. The extender assembly has a tube comprising a hole formed in an upper end of the tube and interior threads formed in a side wall of the hole engage with exterior threads formed on the support rod to removably mount the extender assembly to the tool. The extender assembly is adjustable in length. Further, the tube has a slot formed in a side wall of the tube along an axial direction of the tube and can receive insertion of a threaded extension rod through an opening formed in a lower end of the tube. A limiter pin inserted through the slot and into an aperture formed in an upper end of the extension rod holds the extension rod within the tube and slides along the slot with movement of the extension rod. Further, an extension nut has interior threads within a central hole of the extension nut that engage with exterior threads of the extension rod, such that the extension nut, when turned, presses against the lower end of the tube to secure a position of the extension rod upwardly or downwardly with respect to the tube.

Yet another embodiment of this disclosure is a system for installing tiles that includes a tile installation tool that has a support plate, a tile support bar, a support rod connected to the support plate. The tile support bar is slidably engaged with the support rod and the support rod supports the tile support bar in a selected position relative to a position of the support plate. The tile installation tool has a securing nut that secures the tile support bar in the selected position to provide support to a lower edge of at least one tile, and a means for securing the tool in a recess formed in a wall.

In one example of this embodiment, the support plate includes apertures for receiving insertion of screws, and the means for securing comprises screws. In another example, the means for securing comprises an extender assembly having an adjustable length.

Yet another embodiment of this disclosure is a method for installing tiles above a niche formed in a wall. The method includes providing a tile installation tool that has a support plate, a tile support bar, a support rod connected to the support plate that supports the tile support bar in a selected position relative to a position of the support plate, and a securing nut. The securing nut is configured to secure the tile support bar in the selected position to provide support to a lower edge of at least one tile. The tile installation tool also has screws. The method includes inserting the screws through apertures formed in the support plate, screwing the screws into an upper surface of the niche above the support plate to secure the tool to the surface, adjusting the position of the tile support bar to the selected position by turning the securing nut, and positioning the at least one tile so that the lower edge of the at least one tile abuts the tile support bar.

While multiple embodiments are disclosed, still other embodiments of the present invention will become apparent to those skilled in the art from the following detailed description, which shows and describes illustrative embodiments of the invention.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

Figure 1:
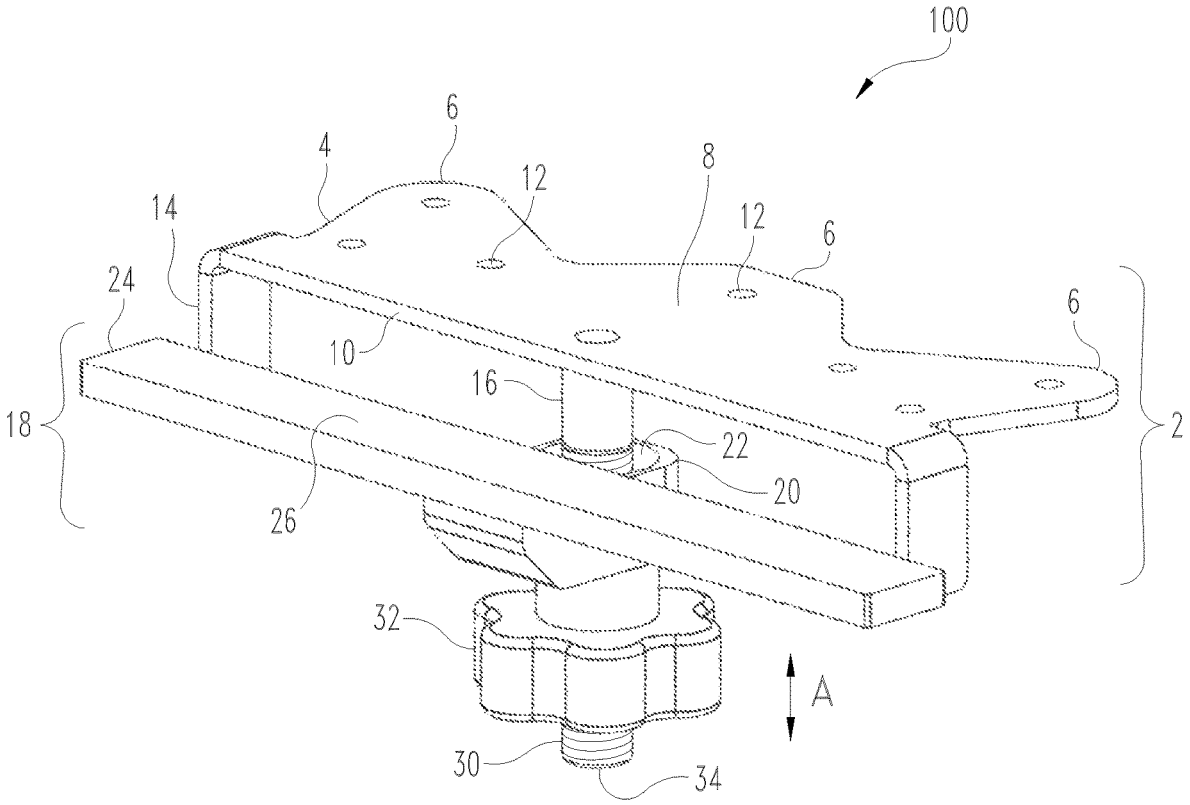
FIG. 1 is a perspective view taken from the front side of a tool according to a first embodiment of the present disclosure.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 2:
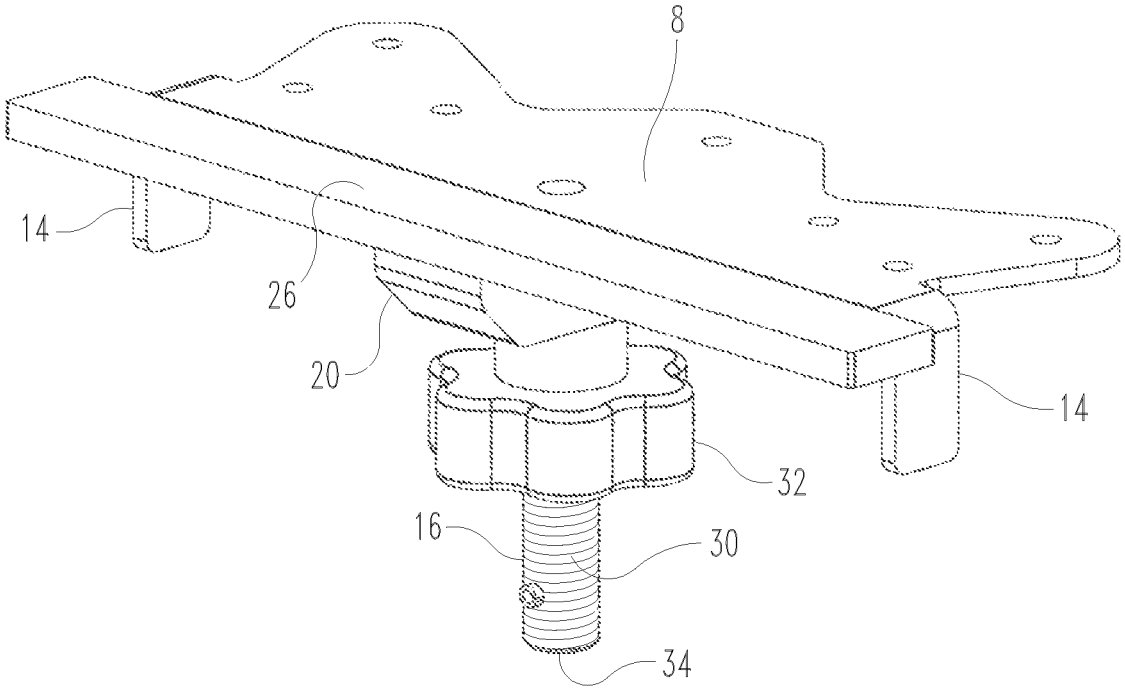
FIG. 2 is another perspective view of the tool of FIG. 1.

FIGS. 1 and 2 are perspective views taken from the front side of a tool 100 according to a first embodiment of the present disclosure. The principal parts of the tool 100 are a head portion 2, a support rod 16, a tile supporter 18, and a tile supporter securing nut 32. The head portion 2 includes a main support plate 4 having a horizontal upper surface 8 configured to abut the upper interior surface U of a recess formed in a wall, such as a niche formed in a side wall of a shower/bath surround. The upper surface 8 may be flat. The plate 4 is configured to be removably secured or affixed to, or otherwise braced and held against, an upper surface of the niche.

Figure 3:
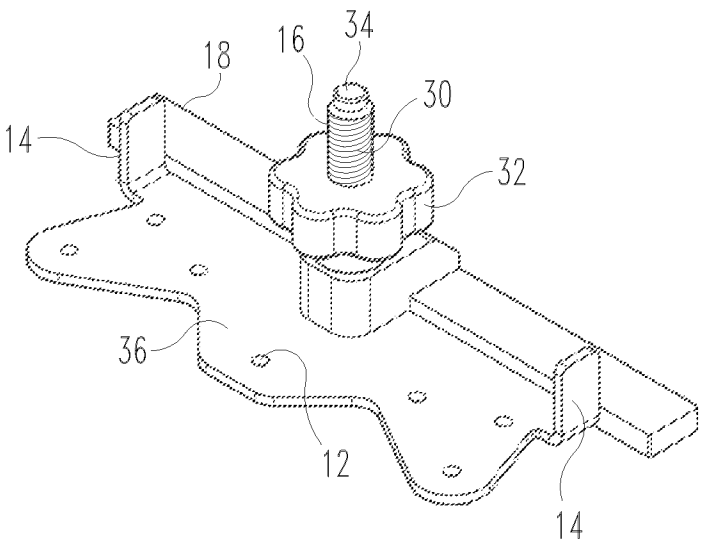
FIG. 3 is a perspective view of the tool of FIG. 1 taken from a bottom or underside side of the tool.

The support plate 4 may be formed in a "crown" type of shape as depicted in FIGS. 1 and 2, or in any other suitable shape. The support plate 4 has screw holes 12, 12 in the nature of openings in the plate 4 for receiving insertion of screws S, S, or nails or similar securing devices. The screw tips are inserted into the holes 12, 12 with their heads below the plate 4. FIG. 3 shows the tool 100 from its underside, showing the bottom surface 36 of the support plate 4 from which the screws S, S are to be inserted. After insertion through the plate 4 from this bottom surface 36, the tips of the screws S, S are screwed into the upper surface U of the niche, which may be formed of wood or any other drillable material. In this manner the support plate 4 may be secured to the upper surface U of a niche so that the support plate abuts and is fixed to the upper surface.

Any kind of screws that fit the holes in the main support plate 4, sufficient in length, can be used to penetrate the upper surface U of the niche, which may be formed of drillable surfaces such as wood, drywall, or cement boards. Preferably the screws are of a length adequate to reach the studs located above the upper surface U. At least one screw should be placed on each side of the threaded support rod 16. More screws might be necessary depending on the weight of tiles that need to be supported by the tool. The screws preferably may be tightened all the way, to ensure that the tool 100 is installed in a stable fashion and does not move relative to the niche during tile installation. Other known means of temporary installation of the plate 4, such as by using nails instead of screws, may be employed.

In embodiments of the tool 100, the support plate 4 has extensions 6, 6 in the nature of wing-like projections along the plane of the upper surface 8 of the plate 4 resulting in the "crown" shape as shown in the drawing figures. The extensions 6, 6 may be useful to increasing the stability of an installation of the tool 100 by increasing the distance between holes 12, 12 without adding extra weight and material between the holes 12, 12. The tool 100 preferably is installed in a way in which that the support plate 4 will not have any contact with the tiles in need of support.

The support plate 4 has a wall-side surface 10 that may be positioned to be flush with the surface of the wall into which the niche or recess was formed. The support plate 4 may have extended portions in the nature of side wings 14, 14 that extend downwardly, in a direction opposite to that of the horizontal upper surface 8 of the support plate. The wall-side surface 10 of the plate 4 preferably is installed so as to be flush with the wall-side surface of the wings 14, 14 so that the wall-side surface of the wings also is flush with the wall in which the niche is formed.

Figure 4:
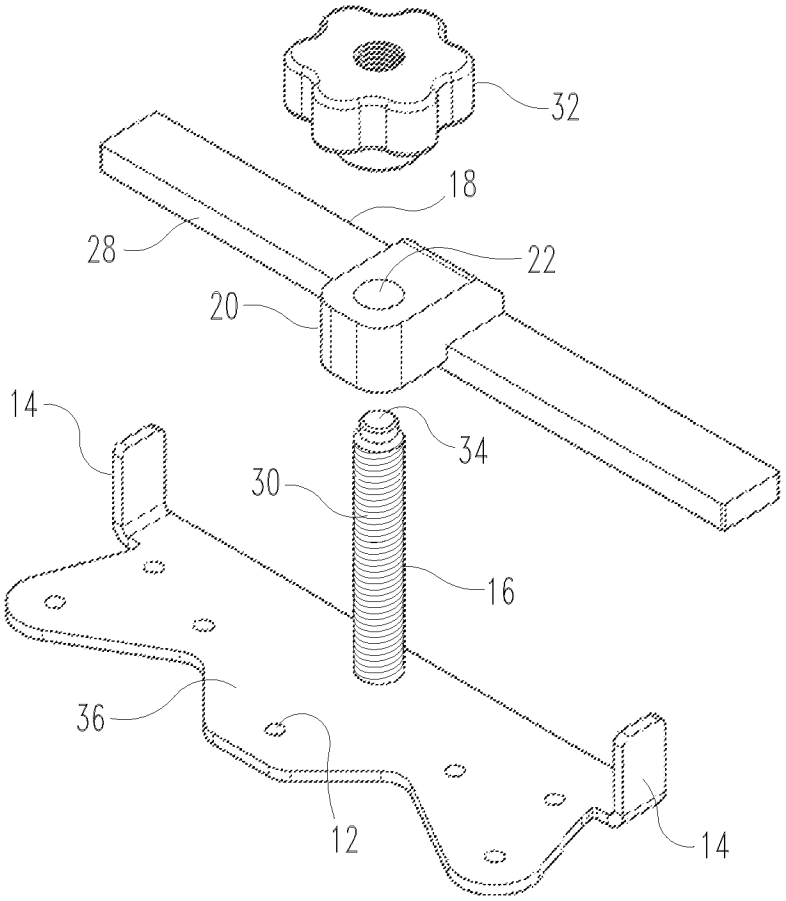
FIG. 4 is an exploded perspective view showing parts of the tool of FIG. 1 taken from a bottom or underside of the tool.

The wings 14, 14 are seen in the underside views of the tool 100 shown in FIG. 3 and FIG. 4. The wings may be formed as bent-down portions of the plate 4. FIG. 3 shows the underside of the tool including its lower surface 36 from which screws may be inserted into screw holes 12, 12 for installing; the tool 100 in the niche. FIG. 4 provides an exploded view of the parts of the tool 100.

The head portion 2 of the tool 100 includes a support rod 16 affixed (permanently or temporarily, preferably permanently) to the support plate 4. The support rod 16 may preferably be affixed on a side of the plate opposite to the horizontal upper surface 8, so that the rod 16 extends downwardly when the upper surface 8 of the plate 4 is installed in abutment with the upper wall (ceiling) surface U of the niche. In an embodiment, the threaded rod 16 has a dimension of approximately 3½ inches long and 0.50 inches wide in diameter, and is affixed in the front center of the support plate 4.

The support rod 16 has exterior threading in the nature of helical threads 30 as shown in FIG. 1. The threads 30, best seen in FIGS. 3 and 4, are formed along at least a portion of the length of the rod 16 near its lower (terminal) end 34, so that the rod may act as a bolt having threads 30 that mate with helical internal threads (not shown) of the securing nut 32. The nut 32 may be turned, preferably by hand using handles as shown in the configuration in FIG. 1, and thus by action of the mated threads, the nut 32 will move upwardly and downwardly along the length of the rod 16 (in the direction of line A in FIG. 1).

The turning of the securing nut 32 in turn will move a tile supporter 18 upwardly and downwardly along the axial direction of the support rod 16 (in the direction of line A in FIG. 1) and thus may be used to fix and secure into a selected position the tile supporter 18. A slider portion 20 of the tile supporter 18 has an aperture 22 through which the rod 16 is inserted so that the slider portion 20 has a sliding engagement with the rod 16, and is held in position along the rod 16 by the position of the nut 32, in the nature of the nut 32 engaging with the rod 16 as a bolt. In this manner, the installer using the tool 100 may, after installing the plate 4 by securing it to the upper surface U of the niche using screws S, S, turn the securing nut 32 so as to move the tile supporter 18 upwardly or downwardly, and to hold the tile supporter 18 in a desired position relative to the plate 4. The slider portion 20 in turn is fixed to a tile support bar 24 of the tile supporter 18. Here, the tile support bar is shown in a rectangular shape. The tile support bar 24 is the element of the tool that contacts the lower edge of the tiles being installed onto the wall surface above the niche. A wall-side surface 28 (shown in FIG. 4) of the tile support bar 24 may abut and slide along the wall-side surfaces of the wings 14, 14, which hold the tile support bar 24 in position and keep it from turning around the axis of the rod 16. In typical use, the tile support bar 24 is the only element of the tool that contacts the tiles being installed above the niche.

As seen by comparing FIG. 1 with FIG. 2, the adjustability of the tile supporter 18 afforded by the installer's turning of the nut 32 permits the installer to secure the lower edge of the supported tiles at a desired position relative to the upper surface 8 of the plate 4. One of the improvements offered by the tool 100 is the ability to finely adjust the tool to select any one of a great number of upward and downward positions of the tile support bar 24, relative to the upper surface U of the niche, which is offered by the action of the mated threads 30 on the support rod 16 and the nut 32 (FIG. 2).

The desired position for the lower edges of the installed tiles might, for example, be flush, or close to flush, with a horizontal plane of the upper surface U of the niche. In this instance, as seen in FIGS. 1 and 2, the installer would adjust the nut 32 so that the upper surface 26 of the tile support bar 24 is flush, or close to flush, with the upper surface 8 of the support plate 4 (see plate 4 in FIG. 1).

In other installations, the desired position for the lower edge of the installed tiles might be slightly lower than the plane of a horizontal upper surface U of the niche. For example, it might be desirable to have the lower edge of the installed tiles extend below the plane of the upper surface U, so that the lower edge of the tiles may meet with a top surface of a layer of tiles, or other wall coverings, later installed upon the upper surface U. In this case, the installer would turn the nut 32 so that the upper surface 26 of the tile support bar 24 is held at a desired position below the upper surface 8 of the plate 4. An example of adjustment to this position is shown in FIG. 1.

In use, after the plate 4 is secured in position in abutment with the upper surface of the niche, and the tile supporter 18 has been adjusted to hold the support bar 24 in its desired position, the installer applies the adherent material to the rear surface of the tiles to be installed in the first horizontal row of tiles above the niche, and positions these tiles so their lower edges are held in the correct position by the tile support bar 24. After the tiles in the first row are in place, the tile support bar 24 may be lowered or raised as needed to reach a desired horizontal level, by turning the nut 32. The tool 100 then is left in position until the adherent material is dry and is securing the tiles in place. After the adherent material is sufficiently dry, the operator may turn the securing nut 32 so as to lower the tile support bar 24 away from the lower edges of the installed tiles. This lowering permits removal of the tool without risking damage to the lower edges of the installed tiles. The operator may remove the screws or nails that are holding the plate 4 in position. This allows the operator to remove the tool 100 for re-use in another application.

The adjustability of the tile supporter 18 afforded by the adjustment of the nut 32 also provides easy and safe removal of the tool 100 after installation of the tiles has been completed and the adherent material has hardened, without damage to the installed tiles. After hardening of the adherent, the nut 32 may be turned to lower the tile support bar 18 so that its upper surface 26 moves downwardly, away from the secured tiles (that is, for example, moving from a position as shown in FIG. 2 to the position as shown in FIG. 1). In this manner, the tool 100 may then be removed from the niche without abutting, and thus possibly damaging, the lower edge of the installed tiles.

Figure 5:
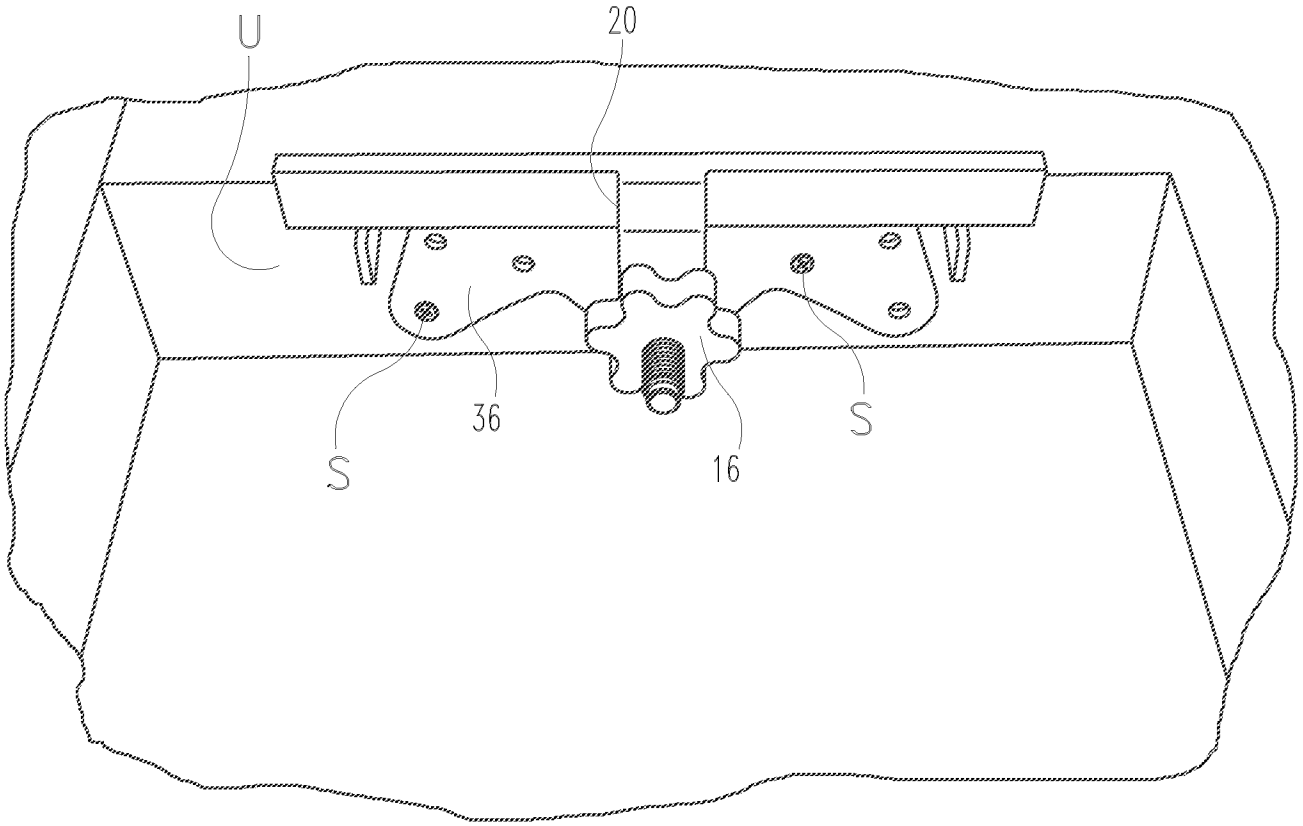
FIG. 5 is a perspective view of the tool of FIG. 1 in a condition of use, taken from a lower frontside of the tool.

FIG. 5 is a perspective view of the tool 100 of FIG. 1 in a condition of use, taken from a lower front side of the tool. In FIG. 5 the tool 100 is installed in a niche, held in position by screws S, S that have been secured through the screw holes 12, 12 into holes formed in the upper surface U of the niche. The number of screw holes 12, 12 formed in the plate 4 may be varied according to the need for support. Preferably the plate 4 has at least two to about eight screw holes 12, 12.

Figure 6:
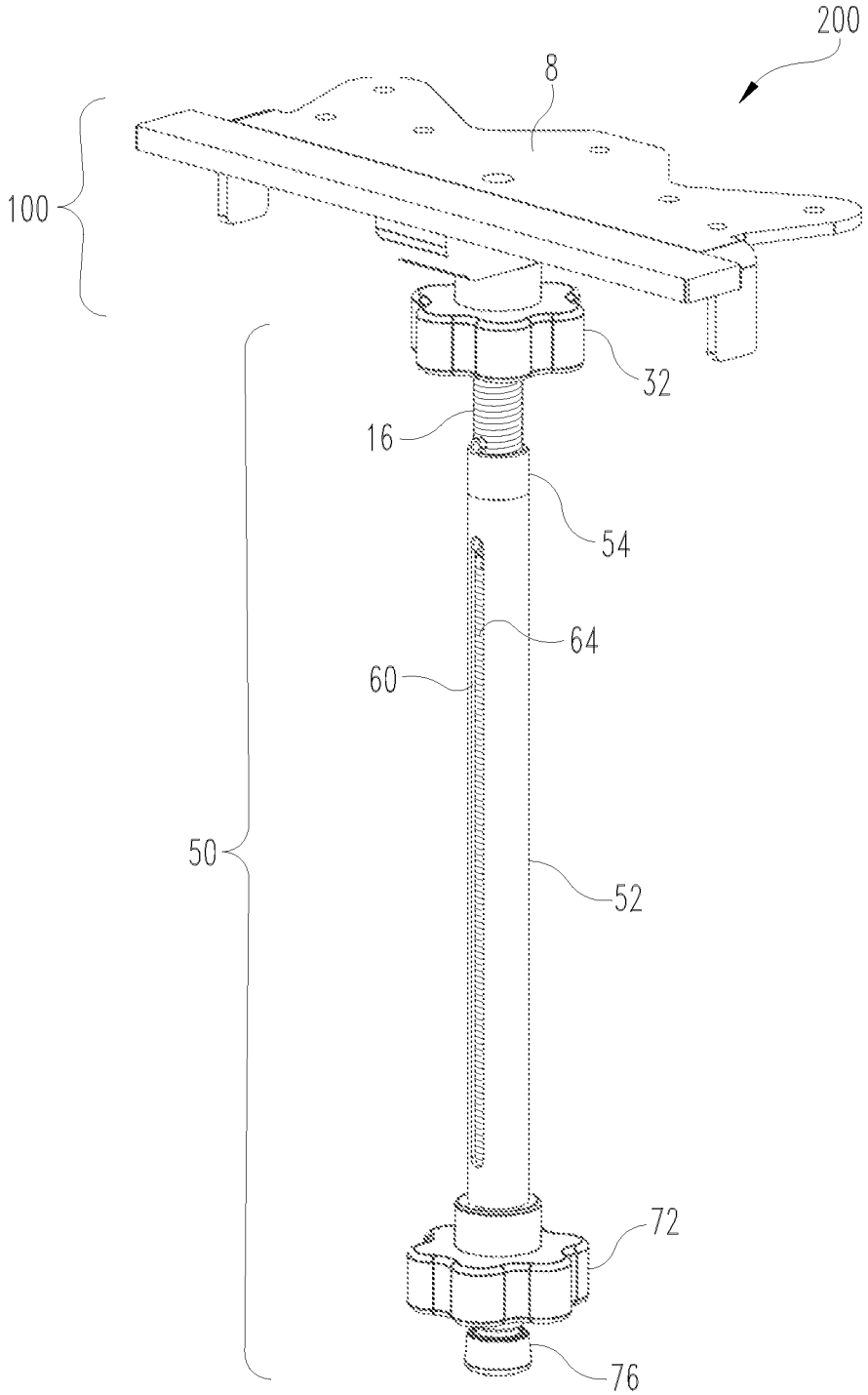
FIG. 6 is a perspective view taken from the front side of a tool according to a second embodiment of the present disclosure.
Figure 7:
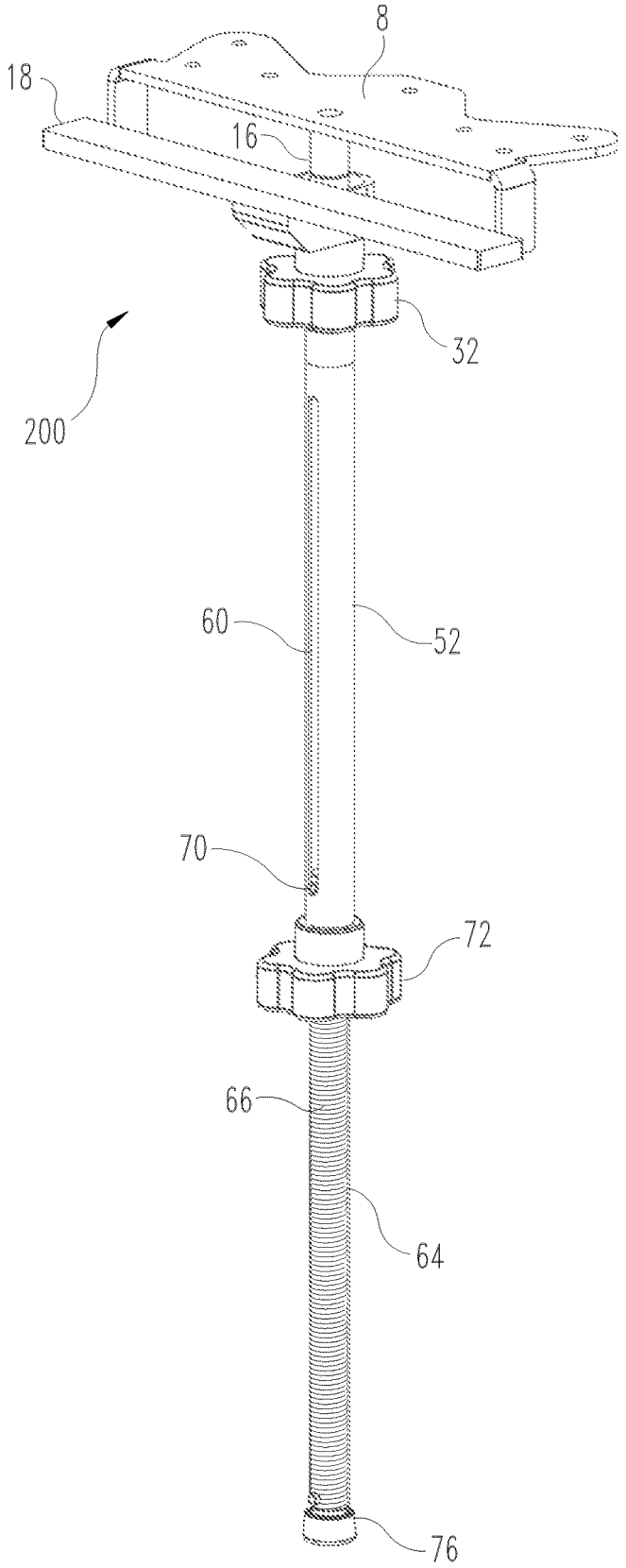
FIG. 7 is another perspective view of the tool of FIG. 6.

FIGS. 6 and 7 are perspective views taken from the front side of a tool according to a second embodiment of the present disclosure. The second embodiment tool 200 includes the tool 100 of FIG. 1 together with an extension assembly 50. FIG. 6 shows the extension assembly in a non-extended position, and FIG. 7 shows the extension assembly in an extended position. The length-adjustable extension assembly is useful for securing the plate 4 in abutment with the upper surface of the niche by bracing the tool in place without the use of screws or nails, for situations in which it is undesirable to make screw or nail holes in the upper surface of the niche.

Figure 8:
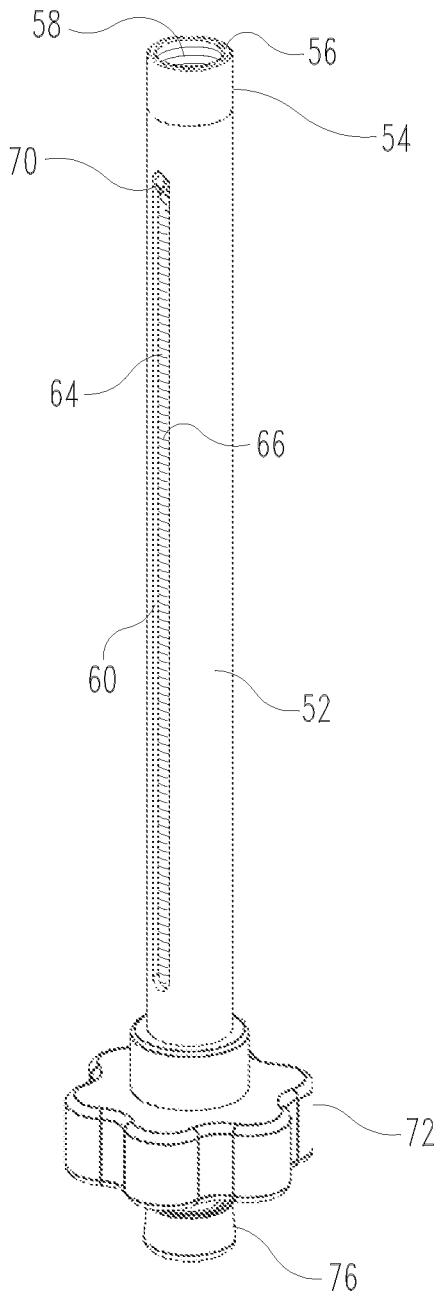
FIG. 8 is a front perspective view of the extender assembly of the tool of FIG. 6.
Figure 9:
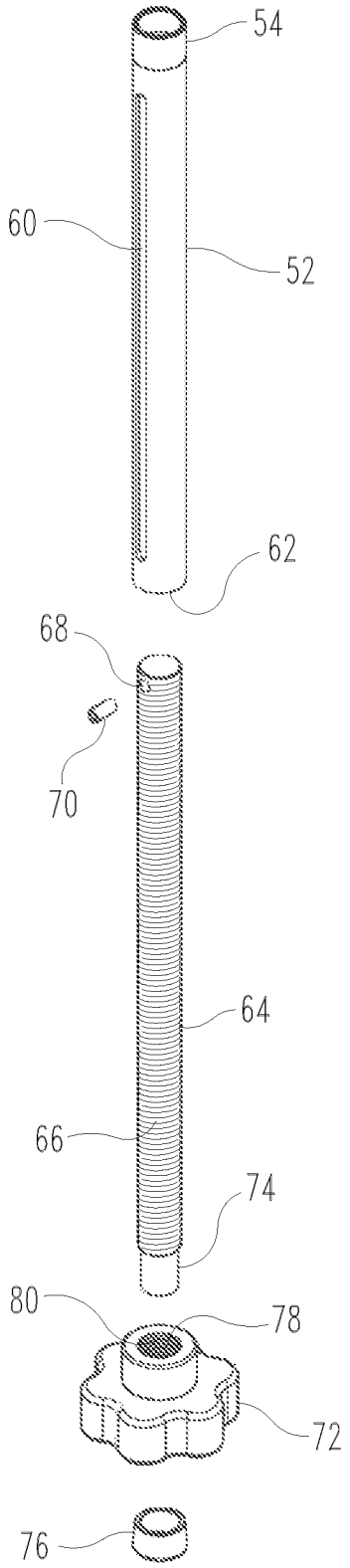
FIG. 9 is an exploded perspective view showing parts of the extender assembly of FIG. 8.
Figure 10:
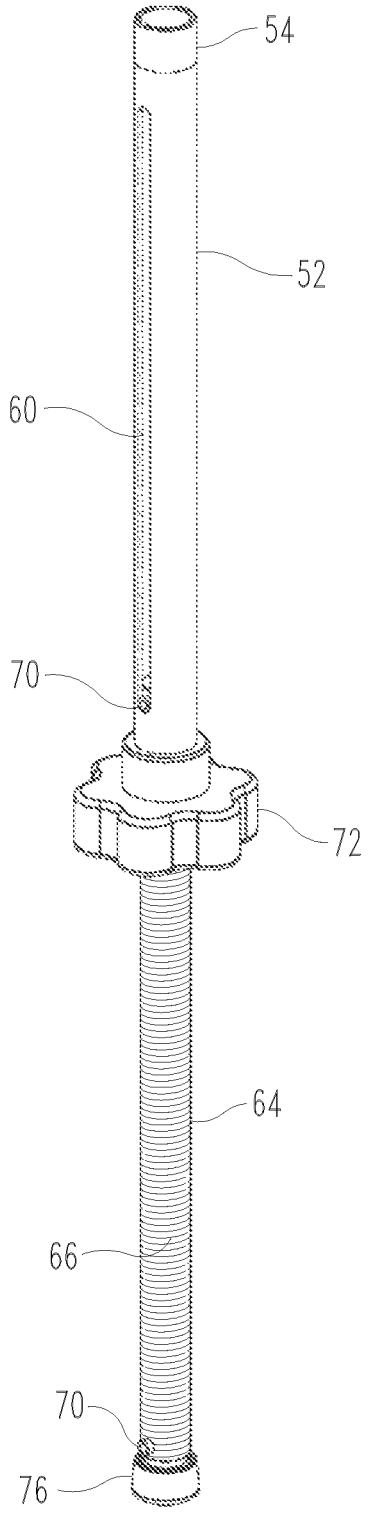
FIG. 10 is another perspective view of the extender assembly of FIG. 8.

FIG. 8 shows the extension assembly 50 in a non-extended position, in contrast to the extended position shown in FIG. 10. FIG. 9 shows parts of the extension assembly in an exploded view. The extension assembly 50 includes a slotted tube 52 having an upper end 54. In the upper end 54 there is formed a recess or hole 56 which bears, on its cylindrical interior side wall, helical threads 58 that are configured to engage and mate with the exterior threads 30 of the lower end 34 of the support rod 16 of the tool 100.

In this way, the tool 100 can be optionally connected to the extension assembly 50 by screwing the lower end of the rod 16 into the threaded hole 56 with the mated threads holding the assembly 50 on the tool 100 in a removable connection. Thus the tool 100 can be adapted to be connected to the extension assembly 50, or removed from assembly 50, at the option of the installer.

The installer has the benefit of choosing whether to secure the tool 100 to the niche using screws, instead of the assembly 50, in the instances where the niche upper surface U is formed of a drillable material such as wood or drywall-type materials. Alternatively, in instances where the upper surface of the niche is not drillable or making holes is not desirable (e.g., upper surface is formed of concrete, or of a water barrier that should not be drilled), the installer may choose to secure or brace the tool 100 in place in the niche using the extension assembly 50. In an example, extra support might be desired, in which case the installer may choose to secure the tool in place both with screws and with the extension assembly.

As seen in FIG. 10, the hollow slotted tube 52 of the extension assembly 50 has a slot formed in its side wall along the axial direction of the tube. The slotted tube 52 is shaped and configured to receive insertion of a threaded extension rod 64, to be inserted through an opening of the tube 52 formed in the lower end 62 of the tube 52, The threaded extension rod 64 includes helical exterior threads 66. After insertion of the extension rod 64 into the slotted tube 52, a limiter pin 70 may be secured in place, through the slot 60 and into an aperture 68 formed in an upper end of the extension rod 64. The aperture 68 is shaped and configured to receive the insertion of the limiter pin 70 and hold the pin 70 in a secure position. In this way, the extension rod is secured in the slotted tube 52, and the limiter pin 70 is free to slide along the slot 60 with movement of the extension rod 64.

An extension nut 72 having helical interior threading in the nature of interior threads 80 formed in an interior side wall of its central hole 78 is shaped and configured to be movably connected to the extension rod 64. The interior threads (not shown) of the extension nut 72 mate with, and move along, the exterior threads 66 of the extension rod 64 when the nut 72 is turned relative to the extension rod 64. During this turning, the limiter pin 70, which extends through, and thus is held in, the slot 60, prevents the tube 52 from rotating along with the rotation of the extension rod 64. In this manner, the installer may adjust the length of the extension assembly to a desired length, by turning the extension nut 72 and thus moving the extension rod 64 upwardly or downwardly within the hollow tube 52. The nut 72 may be turned, preferably by hand using handles as shown in the configuration in FIG. 9, and thus by action of the mated threads, the nut 72 will move upwardly and downwardly along the length of the rod 64, and secure the rod 64 in a selected position in the tube 52.

The nut 32 and the extension nut 72 may be of a standard known design having an inner nut with interior threads, preferably formed of a metal, such as steel or aluminum, and a handle feature allowing an installer to turn the nut by hand. In a known example, such a nut has an outer handle portion formed of a thermoplastic material such as a rigid plastic that is shaped and suited to be gripped and turned by hand so as to have its internal helical screw threads engage with exterior threads of rods such as support rod 16 and extension rod 64. The nut 32 and extension nut 72 may be of similar size, shape, threading, and design. The support rod 16 and the extension rod 64 may have similar diameters, design, and threading, such that manufacture and repair of the tool in its two embodiments 100 and 200 may be accomplished in a simple and efficient manner, because the support nut 32 and the extension nut 72 may be substituted for one another for engagement with either of the support rod 16 and the extension rod 64. Removable limiter pins may optionally be positioned at ends of the support rod and/or the extension rod, as shown in FIGS. 2 and 7, to prevent the support nut 32 and/or the extension nut 72 from traveling so far along the respective rods so as to be removed from engagement with rods, until the pins are removed at the operator's choice.

The lower end 74 of the extension rod 64 may include a cap or cover in the form of a bumper 76 that is configured and formed of a material that will reduce slippage between the lower end 74 of the extension rod 64 and a building surface such as a floor of the niche, or a floor of a room in which the niche is positioned. The bumper may preferably be formed of a thermoplastic material, such as any suitable plastic or rubber materials, such as anti-skid, anti-mar, and/or cushioning thermoplastic materials.

In this manner, the second embodiment tool 200 may be braced in position to support tiles above a niche without screws, if desired, by using the adjustable extension assembly 50. The installer may turn the extension nut 72 to expand the distance between the upper end 54 of the slotted tube 52, which is secured to the support plate 4, and the lower end 74 of the extension rod 64. Thus the upper surface 8 of the support plate 4 may be secured by friction abutment against the upper surface U of the niche by extending the extension assembly 50 to affix the tool 200 in place. A tension is formed between the support plate 4 and the lower end 74 of the extension rod 64 when the lower end 74 of the extension rod 64 presses against a floor of the niche, or the floor of the room in which the niche is formed in a wall. Thus the tool is securely held in position between the upper surface U of the niche and a bottom surface or floor surface, via a wedging force, with friction abutments between the support plate and surface U on the support plate end, and between the lower end of the extension rod and a floor surface or bottom surface of the niche. Similar to the use of the first embodiment tool 100, the securing nut 32 of the second embodiment tool 200 may be turned to adjust the position of the tile supporter 18, and thus in turn the tile support bar 24, upwardly or downwardly as needed, to abut the lower end of the tiles at a desired position. After time for the adherent material securing the tiles to the wall to be hardened sufficiently, the second embodiment tool 200 may be removed. Optionally the securing nut 32 may be turned to lower the tile support bar 24 away from the lower edges of the installed tiles to avoid damage during removal of the tool 200. The tension between the lower end 74 of the extension rod 64 and the support plate 4 may be released by turns of the extension nut 72, and so the tool 200 may be loosened from its installed position and removed.

Figure 11:
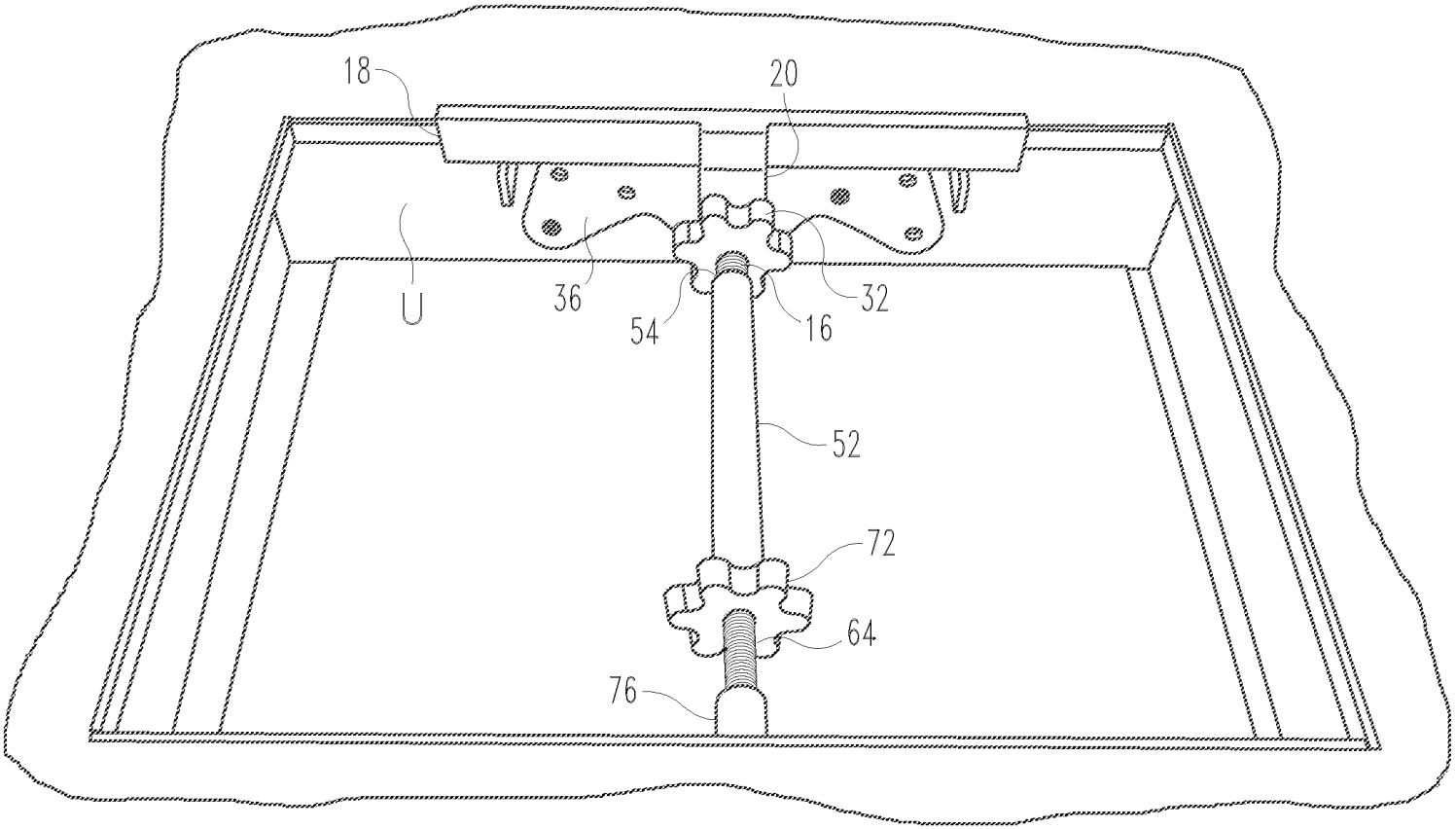
FIG. 11 is a perspective view of the tool of FIG. 6 in a condition of use, taken from a lower front side of the tool.

FIG. 11 is a perspective view of the second embodiment tool 200 in a condition of use. Here, the lower end 74 of the extension rod 64 is covered by a bumper 76 that abuts a bottom surface of a niche. The tool 200 is held in place by forces of tension between the upper and bottom surfaces of the niche, the tension compression or pressure being held via the lower end 74 of the extension rod 64 to the upper surface 8 of the support plate 4. One of the improvements offered by the tool 200 is the large selection of distances between the lower end 74 of the extension rod 64 and the upper surface 8 of the support plate 4, with fine adjustment to extend the length of the extender assembly to wedge the tool into a niche and hold it in place by the compression force. The fine adjustment and large selection is achieved by turning the extension nut 72 to move and hold the extension rod 64 in any selected position relative to the upper end 54 of the slotted tube 52, and in turn, relative to the upper surface 8 of the support plate 4. Thus the tool with its extender assembly is adapted to decrease or increase in length to facilitate use in niches of various heights. Also, in instances where the extension rod is not long enough to allow the tool to reach both the top and bottom surfaces of a niche having a long vertical length, the installer may position the lower end of the tool on top of a support piece, such as a block of wood, so that the tool may be used in taller niches.

As may be appreciated from the above descriptions, the tool 100 and the extendible tool 200 are intended to hold the first row of tiles above a niche, upon which the additional tiles positioned above the first row may be installed either before or during drying of the adhesive material positioned between the tiles and the wall. The tools support the tiles against downward slippage and also allow for proper alignment with the rest of the tiles installed, so that all of the tiles are in the same horizontal line.

In embodiments, the tool also may be employed in horizontal applications where it may be desirable to support tiles along a vertical edge of a wall corner or other feature.

Elements of the tool 100 and the tool 200 may preferably be formed of a metal or metal-containing material. One or more suitable aluminum or steel materials may preferably be used to form one or more of the support plate 4, tile supporter 18, tile support bar 24, support rod 16, slotted tube 52, extension rod 16, and limiter pin 70. Aluminum may be preferred, as having sufficient rigidity and strength while also being lightweight and easy for an installer to handle and transport.

Versatility of application is an improved feature of the tool in that the tool in its embodiments exemplified in FIGS. 1 and 6 can be employed for use with a large variety of wall surfaces, such as drillable surfaces like wood as well as surfaces formed of material that is non-drillable, or where creating holes in the material is undesirable, such as concrete or materials used for waterproofing or insulating walls. The tool provides installers with additional versatility in that the various embodiments such as the screw-on embodiment in FIG. 1 and the extension assembly embodiment in FIG. 6 permit installers to use the tool in niches of many different configurations, shapes, and vertical dimensions. The ease of installation and removal of the tool as described above provides benefits in that the tool may be installed, removed, and reused efficiently and quickly and without waste, as many times as needed, to support a series of vertical columns of tiles to be installed above a niche.

A system is provided in the instant disclosure, comprised of the foregoing elements, comprising, or consisting of, or consisting essentially of, a tool 100 or a tool 200 as described above. The system may comprise securing means such as screws.

Figure 12:
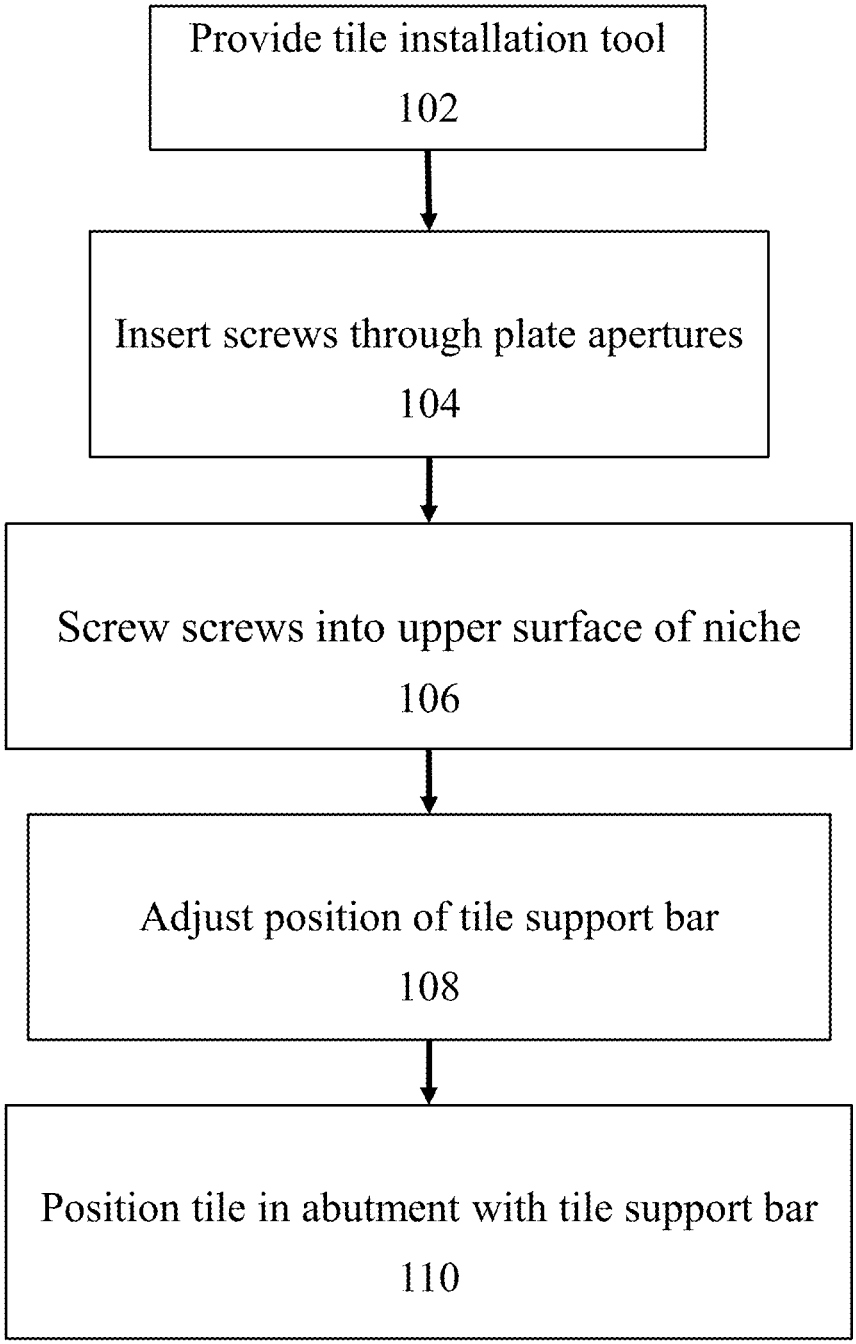
FIGS. 12 and 13 are flow charts showing method steps according to embodiments of the invention.
Figure 13:
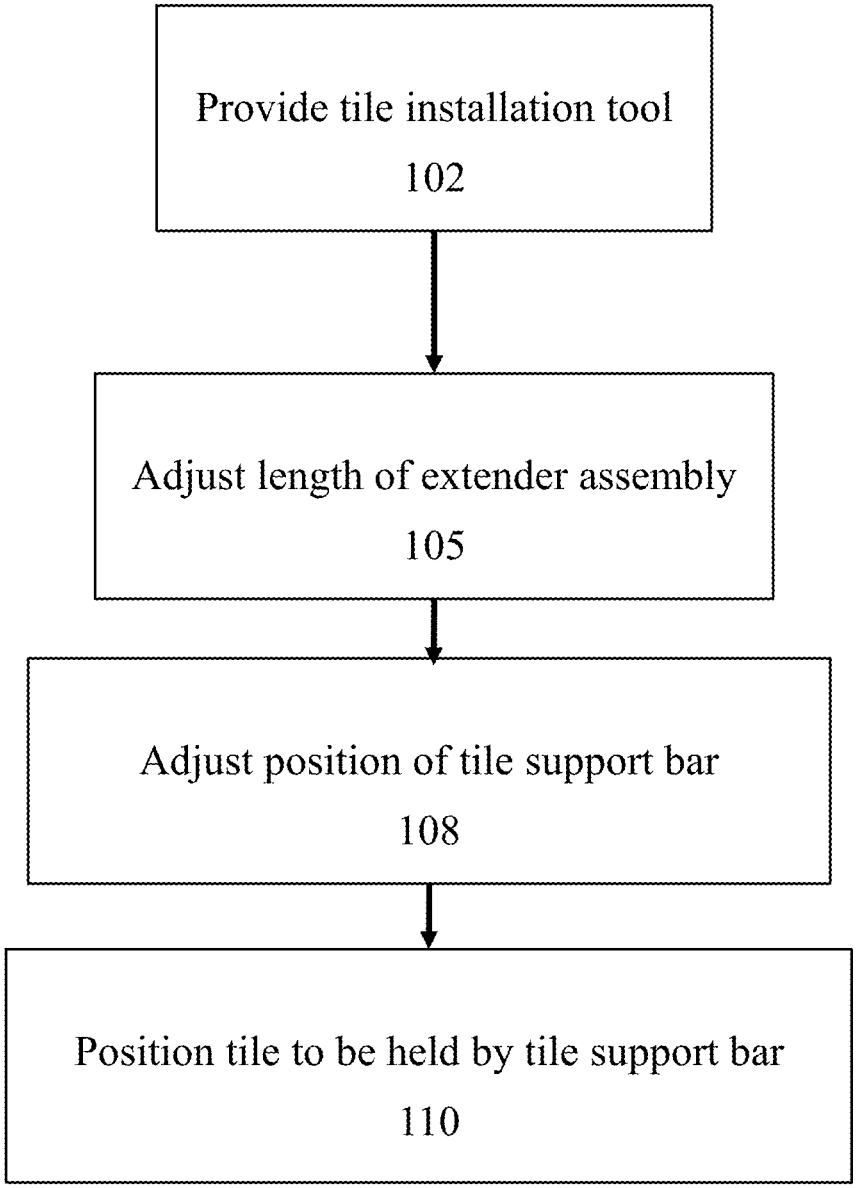

A method is provided for installing tiles using a tool according to any of the embodiments described herein and depicted in one or more of the drawing figures. The method comprises, or consists of, or consists essentially of, steps of employing a tool as in any of the foregoing embodiments, comprising: providing the tool; installing the tool, via optionally (a) installing the tool 100 using securing means affixed through the screw holes 12, 12 in the plate 4; or (b) installing the tool 200 using pressure and friction abutment between the upper surface 8 of the plate and the lower end 74 of the extension rod 64; or (c) installing the tool 200 using both securing means through the screw holes as in (a) and also using pressure and friction abutment as in (b); adjusting the position of the support bar; positioning the tiles above the niche; optionally re-adjusting the position of the support bar; allowing time for the adherent material to harden sufficiently to support the tiles; and removing the tool. Embodiments of the method are depicted in the flow charts of FIGS. 12 and 13. As shown in FIG. 12, an embodiment comprises steps of (102) providing a tile installation tool comprising a support plate, a tile support bar, a support rod connected to the support plate that supports the file support bar in a selected position relative to a position of the support plate, and a securing nut, wherein the securing nut is configured to secure the tile support bar in the selected position to provide support to a lower edge of at least one tile, and screws: (104) inserting the screws through apertures formed in the support plate; (106) screwing the screws into an upper surface of the niche above the support plate to secure the tool to the surface: (108) adjusting the position of the tile support bar to the selected position by turning the securing nut; and (110) positioning the at least one tile so that the lower edge of the at least one tile abuts the tile support bar. In an embodiment depicted in FIG. 13, instead of the screw steps of (104) and (106) of FIG. 12 to secure the tool in position, a step (105) of adjusting a length of an extender assembly to hold the tool in the niche by compression force is employed.

One of skill in the art will appreciate from the foregoing that unexpected benefits are derived from application of the tool, system and method to the problem of installing tiles above a niche, without the need for additional components or parts. Changes to the configuration may add costs, weight, and complexity to manufacture, operation, and maintenance of the tool. A key benefit contemplated by the inventor is improvement of tile installation through use of the disclosed tool, system, and method, while excluding any additional components, steps, or change in structural features. In this exclusion, maximum cost containment may be effected. Accordingly, the substantial benefits of simplicity of manufacture, operation, and maintenance may reside in an embodiment of the invention consisting of or consisting essentially of features of the tool, system, or method as disclosed herein. Thus, embodiments of the invention contemplate the exclusion of steps, features, parts, and components beyond those set forth herein. The inventor contemplates, in some embodiments, the exclusion of certain steps, features, parts, and components that are set forth in this disclosure even when such are identified herein as being preferred or preferable.

It is to be understood that the above description is intended to be illustrative, and not restrictive. Many other embodiments will be apparent to those of skill in the art upon reading and understanding the above description. For example, it is contemplated that features described in association with one embodiment are optionally employed in addition or as an alternative to features described in association with another embodiment. The scope of the invention should, therefore, be determined with reference to the appended claims, along with the full scope of equivalents to which such claims are entitled.

REFERENCE NUMERAL LIST

100 first embodiment tool
2 head
4 support plate
6 extensions of support plate

8 upper surface of support plate
10 wall-side surface of support plate
12 screw holes
14 side wings of support plate
16 support rod with exterior threading
18 tile supporter
20 slider portion
22 aperture in slider portion
24 tile support bar
26 upper surface of tile support bar
28 wall-side surface of tile support bar
30 threads of rod portion
32 tile supporter securing nut
34 lower end of rod portion
36 bottom surface of support plate
S screws
U upper interior wall (ceiling) of niche formed in a wall
A direction of movement of nut 32 and tile supporter 18 along axial direction of rod 16
200 second embodiment tool (with extender)
50 extender assembly
52 slotted tube
54 upper end of slotted tube
56 threaded hole in upper end of slotted tube
58 interior threads in upper hole
60 slot
62 lower end of tube
64 threaded extension rod
66 exterior threads of extension rod
68 aperture for limiter pin
70 limiter pin
72 extension nut
74 lower end of extension rod
76 end bumper
78 central hole of extension nut
80 interior threads in central hole of extension nut

The invention claimed is:

1. A tile installation tool comprising:
a support plate configured to be affixed to an upper surface of a niche of a wall,
an adjustable tile support bar,
a support rod connected to the support plate, and
a securing nut, wherein
the tile support bar is slidably engaged on the support rod,
the support rod has exterior threads,
the securing nut has interior threads that engage with the exterior threads of the support rod to move the securing nut along an axial direction of the support rod, and
the securing nut secures the tile support bar in a selected position relative to a position of the support plate to provide support to a lower edge of at least one tile.

2. The tool according to claim 1, wherein the support plate has a wall-side surface configured to be positioned to be flush with a surface of the wall, and the support plate comprises side wings that extend in a direction opposite to that of a horizontal upper surface of the support plate such that wall-side surfaces of the wings are flush with the surface of the wall.

3. The tool according to claim 1, further comprising an extender assembly configured to be removably mounted to the tool.

4. The tool according to claim 1, wherein the support plate includes apertures for receiving insertion of screws.

5. A tile installation tool comprising:
a support plate configured to be affixed to an upper surface of a niche of a wall,
an adjustable tile support bar engaged with the support plate, wherein the tile support bar is held in a selected position relative to a position of the support plate,
a support rod connected to the support plate, wherein the tile support bar is slidably engaged with the support rod and the support rod supports the tile support bar in the selected position relative to the position of the support plate,
a securing nut, and
an extender assembly configured to be removably mounted to the tool, wherein
the securing nut is configured to secure the tile support bar in the selected position to provide support to a lower edge of at least one tile,
the securing nut engages with exterior threads formed on the support rod to secure the tile support bar in the selected position,
the support plate has a wall-side surface configured to be positioned to be flush with a surface of the wall, and the support plate comprises side wings that extend in a direction opposite to that of a horizontal upper surface of the support plate such that wall-side surfaces of the wings are flush with the surface of the wall,
the extender assembly comprises a tube comprising a hole formed in an upper end of the tube, and
interior threads formed in a side wall of the hole engage with exterior threads formed on the support rod to removably mount the extender assembly to the tool.

6. The tool according to claim 5, wherein
the extender assembly is configured to be adjustable in length.

7. The tool according to claim 6, wherein
the tube has a slot formed in a side wall of the tube along an axial direction of the tube,
the tube is configured to receive insertion of a threaded extension rod through an opening formed in a lower end of the tube,
a limiter pin inserted through the slot and into an aperture formed in an upper end of the extension rod holds the extension rod within the tube and slides along the slot with movement of the extension rod,
an extension nut has interior threads within a central hole of the extension nut that engage with exterior threads of the extension rod, such that the extension nut presses against the lower end of the tube to secure a position of the extension rod upwardly or downwardly with respect to the tube.

8. A system for installing tiles comprising:
a support plate configured to be affixed to an upper surface of a niche of a wall,
an adjustable tile support bar,
a support rod connected to the support plate,
a securing nut, and
means for securing the tool in the niche of the wall, wherein
the tile support bar is slidably engaged on the support rod,
the support rod has exterior threads,
the securing nut has interior threads that engage with the exterior threads of the support rod to move the securing nut along an axial direction of the support rod, and
the securing nut secures the tile support bar in a selected position relative to a position of the support plate to provide support to a lower edge of at least one tile.

9. The system according to claim 8, wherein the support plate includes apertures for receiving insertion of screws, and the means for securing comprises screws.

10. The system according to claim 8, wherein the means for securing comprises an extender assembly having an adjustable length.

11. A method for installing tiles above a niche formed in a wall, comprising:

providing a tile installation tool comprising a support plate, a tile support bar, a support rod connected to the support plate that supports the tile support bar in a selected position relative to a position of the support plate, and a securing nut, wherein the securing nut is configured to secure the tile support bar in the selected position to provide support to a lower edge of at least one tile, and screws;

inserting the screws through apertures formed in the support plate;

screwing the screws into an upper surface of the niche above the support plate to secure the tool to the surface;

adjusting the position of the tile support bar to the selected position by turning the securing nut; and positioning the at least one tile so that the lower edge of the at least one tile abuts the tile support bar.

12. The method according to claim 11, wherein the tool comprises an extender assembly, and comprising the step of adjusting a length of the extender assembly to hold the tool in the niche by compression force.

13. A method for installing tiles above a niche formed in a wall, comprising:

providing a tile installation tool comprising a support plate, a tile support bar, a support rod connected to the support plate that supports the tile support bar in a selected position relative to a position of the support plate, and a securing nut, wherein the securing nut is configured to secure the tile support bar in the selected position to provide support to a lower edge of at least one tile, and an extender assembly configured to be removably mounted to the tool;

adjusting a length of the extender assembly to hold the tool in the niche by compression force;

adjusting the position of the tile support bar to the selected position by turning the securing nut; and positioning the at least one tile to be held by the tile support bar.

* * * * *